United States Patent [19]

Klenk

[11] 4,388,073

[45] Jun. 14, 1983

[54] DEVICE FOR PIVOTING THE KNIFE IN ITS LONGITUDINAL AXIS AND FOR ADJUSTING THE KNIFE DEPTH ON KNIFE FOLDING MACHINES

[75] Inventor: Emil Klenk, Oppenweiler, Fed. Rep. of Germany

[73] Assignee: Maschinenbau Oppenweiler Binder GmbH & Co., Fed. Rep. of Germany

[21] Appl. No.: 273,002

[22] Filed: Jun. 12, 1981

[30] Foreign Application Priority Data

Jul. 18, 1980 [DE] Fed. Rep. of Germany ..... 3027342

[51] Int. Cl.[3] ..... B65H 45/18

[52] U.S. Cl. ..... 493/444; 493/457

[58] Field of Search ..... 493/438–445, 493/449–451, 457

[56] References Cited

U.S. PATENT DOCUMENTS 3,632,104 1/1972 Dufour ..... 493/444

4,175,740 11/1979 Klenk ..... 493/444 X

FOREIGN PATENT DOCUMENTS 932428 9/1955 Fed. Rep. of Germany .

2504489 8/1976 Fed. Rep. of Germany ..... 493/444

*Primary Examiner*—A. J. Heinz

*Attorney, Agent, or Firm*—Harding, Earley & Follmer

[57] ABSTRACT

A device for pivoting the knife in its longitudinal axis and for adjusting the knife depth on knife folding machines having a coupling and brake unit disposed between drive motor and knife drive, for the upwards and downwards movement of the knife bar guided in a housing pivotable in the direction of rotation of the drive, characterized in that in the course of the driving axis there is between drive motor and the coupling-brake unit mounted on the housing an elastically deformable rotary joint and in that a substantially vertically extending guide plate is arranged to be rigid with the machine frame and in that for pivoting the knife there is at the bottom end of the housing a stay bolt, the space-forming length of which is adjustable between housing and guide plate, whereby there is in the upper part of the housing on the guide plate side and parallel with the drive axis, a horizontal pivot arbor which serves as a pivoting axis and in that to adjust the knife depth a substantially vertically disposed setscrew is provided which is in screwthreaded engagement with the pivot arbor and the head of which is rotatably held in a substantially horizontal guide flange in the guide plate and in that at least one locking screw is provided to fix the adjusted vertical knife position, the locking screw being in screwthreaded engagement with the knife bar and having its head resting on the guide plate.

3 Claims, 3 Drawing Figures

DEVICE FOR PIVOTING THE KNIFE IN ITS LONGITUDINAL AXIS AND FOR ADJUSTING THE KNIFE DEPTH ON KNIFE FOLDING MACHINES

BACKGROUND OF THE INVENTION

The invention relates to a device for pivoting the knife in its longitudinal axis and for adjusting the knife depth on knife folding machines having disposed between drive motor and knife drive a coupling and brake unit for the upwards and downwards movement of the knife bar guided in a housing pivotable in the direction of rotation of the drive.

In the case of such a known apparatus, the knife bar is guided in a housing which has a shoulder projecting into an inner shoulder on a housing arm and which is so rotatable in respect of the housing arm that the knife is pivoted in its longitudinal axis. The adjusted position of the housing in respect of the housing arm can be fixed by means of a locking screw. Disposed in the housing arm are the drive elements which at the housing end terminate in a disc having disposed in it an eccentric stud which engages a sliding member mounted on the knife bar, so that the rotary movement of the drive unit is converted to the to-and-fro movement of the knife bar. The housing arm has parallel with the extension of the housing a holder which at its free end and at the height of the folding rollers with which the knife cooperates, is articulated on a housing part at a joint on which there is also mounted an adjusting screw having a threaded seating and the end of which actively engages the holder in the direction of the axis of the housing arm. Upon an adjustment of the setscrew, the arrangement comprising the housing, the housing arm and the holder is pivoted about the pivoting stud on the housing which leads to an adjustment of the knife depth which by reason of the considerable pivoting radius can in its direction of action be regarded very closely as a linear displacement of the knife (German Offenlegungsschrift No. 25 04 489).

It is true that the known device permits of a negligible adjustment of the knife depth while the machine is running but this adjustment is linear only over very minimal height differences so that upon pronounced adjustments alignment of the folding roller gap in relation to the knife is guaranteed only if the knife held in a clamping mounting on the knife bar is realigned by being pivoted about its longitudinal axis, which can in turn be undertaken only while the machine is stationary. Also rotation of the housing in respect of the housing arm can be carried out, once the locking screw has been undone, only while the machine is stationary, since via the guide of the knife bar, the housing is acted upon by drive forces which do not permit of an accurate and reliable adjustment of the housing in relation to the housing arm while the machine is operating.

To regulate the length of the knife adjustment in the case of a sheet folding machine while it is in operation, it is furthermore known to mount on the end of a long supporting arm which bridges the major part of half of the sheet to be folded in extension thereof a parallelogram guide for the folding knife. Acting upon the parallelogram guide, in order to lift the knife, is a pull rod, the effective length of which is adjustable (German Pat. No. 932 428).

It is indeed possible with this known and structurally complicated device to adjust the knife depth even while the machine is operating but pivoting of the knife in its longitudinal axis is not however possible.

SUMMARY OF THE INVENTION

The problem on which the invention is based resides in employing structurally simple means in order to develop the device of the type described at the outset so that while the machine is operating accurate adjustment of the knife depth in the effective plane of the knife can be carried out over considerable heights while the knife can be pivoted in its longitudinal axis.

On a basis of the device of the type described at the outset, this problem is resolved in that in the course of the driving axis there is between drive motor and the coupling-brake unit mounted on the housing an elastically deformable rotary joint and in that a substantially vertically extending guide plate is constructed to be rigid with the machine frame and in that for pivoting the knife there is at the bottom end of the housing a stay bolt, the space-forming length of which is adjustable between housing and guide plate whereby, there is in the upper part of the housing on the guide plate side and parallel with the drive axis, a horizontal pivot arbor which serves as a pivoting axis and in that to adjust the knife depth a substantially vertically disposed setscrew is provided which is in screwthreading engagement with the pivot arbor and the head of which is rotatably held in a substantially horizontal guide flange in the guide plate and in that at least one locking screw is provided to fix the adjusted vertical knife position, the locking screw being in screwthreaded engagement with the knife bar and having its head resting on the guide plate.

The device according to the invention has the advantage that while the machine is running and after the locking screw has been released, turning of the setscrew makes it possible for the housing with the coupling-brake unit mounted thereon and the knife bar guided in it to be adjusted together with the knife upwardly or downwardly to the desired height and in the plane of the knife action. The adjusted knife depth is then fixed by tightening the locking screw. The consequently altered alignment between the drive shaft and the input side of the coupling-brake unit is compensated for by the elastically deformable rotary joint. Since this rotary joint is disposed between coupling and drive, it is constantly turning while the machine is running so that it need not be braked during operation. The pivoting of the housing which results in the knife being pivoted in its longitudinal axis, is effected by means of the stay bolt engaging the housing and the adjustment of which is fixed when the locking screw is tightened.

In an advantageous embodiment of the device, the threaded shank of the stay bolt fixed on the housing protrudes through an elongated hole in the guide plate and carries a milled nut, the stay bolt being enclosed by a coiled thrust spring between the housing and the guide plate. This arrangement permits of easy pivoting of the housing and thus of the knife in its longitudinal direction, the necessary rotary movement of the milled nut required for pivoting being readily feasible while the machine is running, once the locking screw has been slackened.

Through the vertical cut-out provided on the housing, it is possible for the housing to be guided in an extremely simple manner on the guide plate.

The invention is explained by way of example in greater detail hereinafter, with reference to the drawings.

DESCRIPTION OF THE PREFERRED EMBODIMENT

Figure 1:
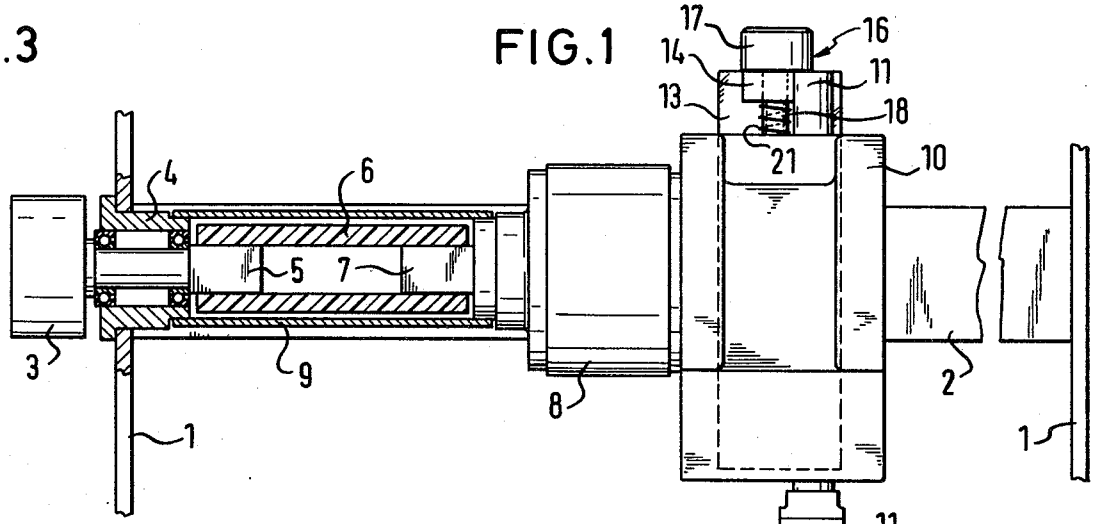
FIG. 1 diagrammatically shows a partially sectional front view of the device.
Figure 2:
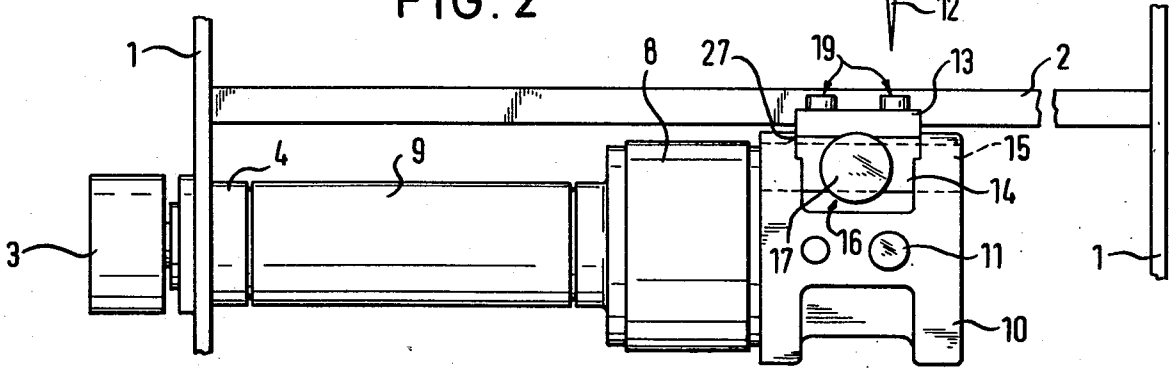
FIG. 2 is a plan view of the device in FIG. 1.
Figure 3:
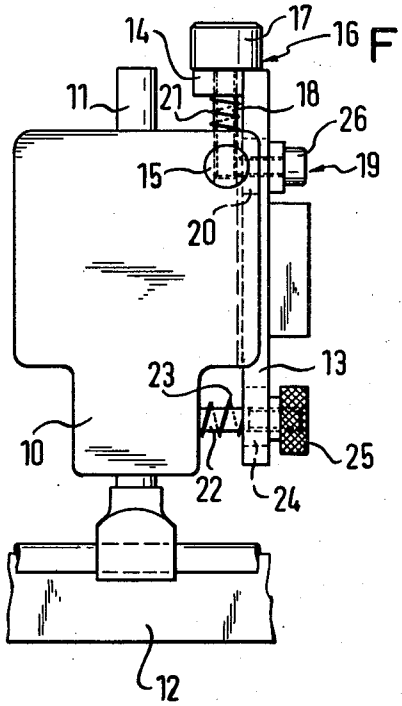
FIG. 3 is a side view of the device in FIG. 1.

Of the knike folding machine, FIGS. 1 to 3 show parts of the machine frame 1 and a frame cross-member 2 connecting these parts. Mounted on the machine frame part 1 via a bearing 4 is the output shaft of a drive motor 3. The output shaft ends in a square tang 5 which engages in rotationally rigid fashion in an elastically deformable sleeve 6 at the bottom end of which rests, in rotationally rigid manner, a square tang 7 of a coupling-brake unit 8. The sleeve 6 is enclosed by a protective sheath 9.

The coupling-brake unit 9 is flanged on a housing 10. The knife bar 11 carrying the knife 12 is guided in the housing 10 and is connected to a (not shown) drive intended to carry out the upwards and downwards movement.

At its rear, the housing 10 has a cut-out 27 into which a guide plate 13 is inserted. The guide plate 13 is mounted substantially vertically on the frame cross-member 2.

On the guide plate side and in the upper part of the housing 10 there is mounted a substantially horizontal pivot arbor 15. At its upper end, the guide plate 13 has at a right-angle to it a guide flange 14 with a bore orientated in line with the bore in the upper side of the housing 10. Through the bore in the guide flange 14 and through the bore in the upper side of the housing 10 extends a threaded shank 18 of a setscrew 16. The threaded shank 18 is screwed into a threaded bore which passes through the pivot arbor 15. The head 17 of the setscrew 16 rests on the guide flange 14. Located between the guide flange 14 and the upper side of the housing is a coiled thrust spring 21.

Constructed in the guide plate 13 there are in the upper part two elongated holes 20 through which extend locking screws 19 which engage into threaded bores in the pivot arbor 15. The head 26 of each locking screw 19 rests against the guide plate 13.

Also provided in the lower part of the guide plate 13 is an elongated hole 24. A stay bolt 22 fixed on the housing 10 extends through this elongated hole. Located between the guide plate 13 and the wall of the housing there is a coiled thrust spring 23 extending around the stay bolt 22. At the end of the stay bolt 22 which projects from the elongated hole 24 there is a screwed-on milled nut 25.

For pivoting of the knife 12 in its longitudinal direction, the milled nut 25 is rotated while the locking screws 19 are slackened, until such time as the desired position has been reached. Vertical adjustment occurs by turning the head 17 of the setscrew 16. When this is done, the housing 10 is moved in relation to the guide plate 13, the guidance being achieved by the cut-out 27 on the housing 10 into which the guide plate 13 projects. The coupling-brake unit 8 flanged onto the housing 10 is adjusted or pivoted simultaneously with this latter. The resultant deviation between output shaft of the motor 3 which is rigid with the machine and of the drive shaft of the coupling-brake unit 8 is compensated by the elastic sleeve 6.

If the desired knife depth position is achieved by turning the head 17 of the setscrew 16 and the desired pivoting of the knife in its longitudinal direction is achieved by turning the milled nut 25, the locking screws 19 can be tightened so that the adjustment carried out without interrupting operation is fixed.

What is claimed is:

1. In knife folding machines having a coupling and brake unit disposed between and drivingly connecting a rotatable motor drive shaft and a knife drive, for the upwards and downwards movement of a knife bar guided in a housing and carrying an elongated folding knife which cooperates with additional folding elements to produce a folding action, said housing being pivotable about the axis of rotation of the drive shaft, said knife drive being mounted as a unit in said housing to move said knife, a device for pivoting the knife about its longitudinal axis and for adjusting the position of the knife relative to the cooperating folding elements, said position adjusting farther characterised in that there is between said drive shaft and the coupling-brake unit mounted on the housing an elastically deformable rotary joint drivingly connecting the drive shaft to the coupling and brake unit and in that a substantially vertically extending guide plate is arranged to be rigid with a machine frame and in that for pivoting the knife there is at a bottom end of the housing a stay bolt, the length of which is adjustable to vary the space between the housing and guide plate, whereby there is in an upper part of the housing on the guide plate side and parallel with the drive shaft axis, a horizontal pivot arbor which serves as a pivoting axis and in that to adjust the knife position a substantially vertically disposed setscrew is provided which is in screwthreaded engagement with the pivot arbor and its head is rotatably held in a substantially horizontal guide flange in the guide plate and in that at least one locking screw is provided to fix the adjusted vertical knife position, the locking screw being in screwthreaded engagement with the knife bar and having its head resting on the guide plate.

2. A device according to claim 1, characterised in that the threaded shank of the stay bolt fixed on the housing protrudes through an elongated hole in the guide plate and carries a milled nut, the stay bolt being enclosed by a coiled thrust spring between the housing and the guide plate.

3. A device according to claim 1 or 2, characterised by a vertical cut-out constructed on the housing and through which the housing on the guide plate is guided.

* * * * *